US010733831B2

(12) United States Patent
Ballone

(10) Patent No.: US 10,733,831 B2
(45) Date of Patent: Aug. 4, 2020

(54) GAMING DEVICE HAVING EXTERNAL SYMBOLS THAT CREATE A SYMBOL MATRIX

(71) Applicant: High 5 Games, LLC, New York, NY (US)

(72) Inventor: Jonathan Ballone, Hoboken, NJ (US)

( * ) Notice: Subject to any disclaimer, the term of this patent is extended or adjusted under 35 U.S.C. 154(b) by 194 days.

(21) Appl. No.: 15/648,823

(22) Filed: Jul. 13, 2017

(65) Prior Publication Data

US 2018/0018853 A1 Jan. 18, 2018

Related U.S. Application Data

(60) Provisional application No. 62/361,893, filed on Jul. 13, 2016.

(51) Int. Cl.
*G07F 17/32* (2006.01)

(52) U.S. Cl.
CPC ..... *G07F 17/3213* (2013.01); *G07F 17/3223* (2013.01); *G07F 17/3244* (2013.01); *G07F 17/3267* (2013.01); *G07F 17/3288* (2013.01)

(58) Field of Classification Search
CPC ..... G07F 17/3213; G07F 17/3288; G07F 17/3267; G07F 17/32
See application file for complete search history.

(56) References Cited

U.S. PATENT DOCUMENTS 6,227,971 B1 * 5/2001 Weiss ..... G07F 17/3244 273/143 R
2002/0198039 A1 * 12/2002 Marks ..... A63F 13/005 463/20
2003/0190948 A1 * 10/2003 Baerlocher ..... G07F 17/34 463/20
2004/0072605 A1 * 4/2004 Toyoda ..... G07F 17/32 463/16
2006/0030387 A1 * 2/2006 Jackson ..... G07F 17/3211 463/16
2006/0073880 A1 * 4/2006 Thomas ..... G07F 17/32 463/20
2006/0111174 A1 * 5/2006 Baerlocher ..... G07F 17/3202 463/20
2008/0064466 A1 * 3/2008 Saito ..... G07F 17/34 463/16
2008/0171587 A1 * 7/2008 Jackson ..... G07F 17/32 463/20
2008/0287179 A1 * 11/2008 Berman ..... G07F 17/34 463/20
2009/0247276 A1 * 10/2009 Okada ..... G07F 17/3227 463/20

(Continued)

*Primary Examiner* — Omkar A Deodhar
*Assistant Examiner* — Shauna-Kay Hall
(74) *Attorney, Agent, or Firm* — Jonathan Fallon, Esq.

(57) ABSTRACT

A game comprising: a symbol matrix comprising a plurality of interior matrix positions; a plurality of exterior symbol positions; a set of program instructions executable to implement: selecting and displaying a symbol to display in each of the exterior symbol positions; determining what symbol to display in each interior matrix position based the symbols displayed in the exterior symbol positions; determining whether to issue an award based on the symbols displayed in the interior matrix positions; and issuing an award if the program instructions so designate.

13 Claims, 8 Drawing Sheets

(56) References Cited

U.S. PATENT DOCUMENTS

| | | | | |
|---|---|---|---|---|
| 2010/0056254 | A1* | 3/2010 | Jackson | G07F 17/32 463/20 |
| 2010/0113133 | A1* | 5/2010 | Leupp | G07F 17/34 463/20 |
| 2012/0122542 | A1* | 5/2012 | Montenegro | G07F 17/3265 463/20 |
| 2013/0303260 | A1* | 11/2013 | Louie | G07F 17/34 463/21 |
| 2014/0121000 | A1* | 5/2014 | Porter | G07F 17/3244 463/20 |
| 2014/0274288 | A1* | 9/2014 | Hornik | G07F 17/34 463/20 |
| 2015/0031437 | A1* | 1/2015 | Gomez | G07F 17/3267 463/20 |

* cited by examiner

300

GAMING DEVICE HAVING EXTERNAL SYMBOLS THAT CREATE A SYMBOL MATRIX

CROSS-REFERENCE TO RELATED APPLICATION

The present application claims priority to U.S. Provisional Patent Application Ser. No. 62/361,893 entitled "GAMING DEVICE HAVING MATCHING REELS WITHIN A PLAY MATRIX" filed Jul. 13, 2016 the disclosure of which is incorporated herein by reference in its entirety.

BACKGROUND

Field of the Invention

Embodiments of the present invention generally relate to a gaming device having exterior symbols on the outside of a play matrix that may align or coordinate to populate the play matrix, or the like. More specifically, embodiments of the present invention relate to a slot machine game having exterior symbols that appear above and to the left of a play matrix, wherein if an exterior symbol above a first symbol position is the same as an exterior symbol to the left of the first symbol position, the first symbol position is populated with the matching symbol, or the like.

Description of Related Art

To play a conventional slot machine, a player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. If the coins, gaming tokens or paper currency are validated as authentic, the player accrues the appropriate number of playing credits on a credit meter. For example, a twenty-five cent gaming machine will accrue four credits for each dollar deposited into the gaming machine. After accruing credits on the credit meter, the player determines how many credits he wishes to wager on the next spin of the slot reels. After setting the wager, the player spins the reels by pressing the spin button or by pulling a handle. When the reels stop spinning, symbols are displayed on the slot reels. The player then collects credits for winning combinations, if any, according to a pay table. More specifically, the slot machine operates as follows:

Reels

Slot game symbols may be located on one or more reels. Reels may be physical reels, digital reel strips, and/or the like. Digital reel strips may include an arrangement of symbols stored digitally, or the like. Symbols disposed on a physical reel physically spin when the reel spins. Some electronic slot machines include a processor working with a display to depict a simulation of a reel spinning, or the like. A slot game may include a processor, memory, and a display working together to display a digital representation of a physical reel after a player activates a game.

As used herein, the term "symbol" may refer to an indicia or indicator. At the conclusion of a game or spin, certain combinations of symbols may result in a reward for the player. In physical reels, symbols are displayed on the reel at various points around the outer circumference of the slot reel. Digital reels include various symbol positions, or positions on the reel strips where symbols are positioned.

Reels may be placed or displayed adjacent to each other, and are often arranged in columns. In most embodiments, there are at least three reels in the reel sets and most often at least five.

Symbol Matrix.

A symbol matrix or play matrix is the window of the reels that is displayed to a player and shows the final symbol configuration in order to determine awards. Generally speaking, a symbol matrix will show portions of 3 or more slot reels (also called "columns") placed adjacent to each other. Each column in the symbol matrix contains at least 3 or 4 rows and shows a portion of a reel that may have a symbol in each row. The resulting matrix of symbols typically ranges from 3 columns by 3 rows with 9 total symbols to 5 columns by 4 rows with 20 total symbols. Within the symbol matrix, positions on the slot reels may be referred to according to column, from left to right, and row, from the top to bottom ("symbol positions"). For example: symbol position 1/2 is located in column 1 (i.e., left-most column) and row 2 (i.e., second row from the top); symbol position 2/3 is located in column 2 (i.e. the second left-most column) and row 3 (i.e., third row from the top).

In some slot machines, such as mechanical slot machines, the symbol matrix can be an open window showing a corresponding position of the reels as they spin. In other embodiments, such as for electronic slot machines, the symbol matrix shows the spinning reels by electronically displaying the reel stored in memory spinning. This can be accomplished by animating the reels stored in the memory or by displaying each symbol on a reel as a new symbol is needed for display.

A random (or pseudorandom) number generator well-known in the art is used to determine stop positions for the reels. The processor can use any known random number generator function known in the art such as those using the linear congruential generator which uses the recursive relation: $X_{n-1}=(aX_n+c)$ mod in where X is the sequence of pseudorandom values and in is the modulus, a is the multiplier, c is the increment, and $X_0$ is the seed value. It should be appreciated that other random or pseudo random number generators can be used including those that are built-in functions in java, c, c++, and the like.

In some embodiments, for each reel, the random number generator will return a number equal to or less than the number of symbols in that reel—a "stop position" for each reel. This number determines the final symbols to display in the symbol matrix. In some such embodiments, the number will correspond to a symbol position on the reels. The corresponding symbol position on the reels would then be the top symbol from a reel displayed in the symbol matrix. The game rules would determine how many symbols from that reel to display. This process is repeated for each reel. It should be appreciated that the random number generated can determine which symbol is in the bottom position, middle position, or the like. It should further be appreciated that often the reels will be stored in arrays beginning in zero and that a number generated may appear to be off by a set number from the randomly generated number.

In some embodiments, the visible matrix may display one symbol from each reel visible on the display device ("independent reels"). In these embodiments, the single symbol position from each reel may be vertically aligned or stacked on top of each other so as to appear as a single reel or column to a player on a display device.

It should also be appreciated that the random number for the stop positions can be generated sequentially, simultaneously, or as close to simultaneously as possible.

In some embodiments, the processor generates a new final symbol matrix based on the ultimate outcome and displays this temporary symbol matrix in the symbol matrix.

Winning Combinations.

Players collect credits for predetermined winning symbol combinations that appear in specific positions ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1.

Players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table.

Credits are awarded to the player for each winning symbol combination based on a predetermined schedule. For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Following any type of pay (e.g., line pays, line scatter pays, or reel scatter pays), credits won are added to the player's credit balance shown on the credit meter. As long as the player has credits on the credit meter, the player may continue to play the game. Following any spin, the player may collect the credit balance by pressing the Cash Out button.

In other slot machines, players are awarded for the numerical value of symbols appearing on a display device without regard to their alignment. This concept, known as What You See Is What You Get ("WYSIWYG"). In these embodiments, players are issued awards based on each numeric symbol appearing in certain symbol positions that are displayed without regard to the alignment of the symbols as further disclosed in United States Patent Publication 2011-0165934 which is incorporated by reference in its entirety as if fully set forth herein.

While the above elements are common to many slot machine games, without more, players are often easily bored by simple conventional game play. Therefore, there is a need for a gaming apparatus having an improved game play to attract more players.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1A:
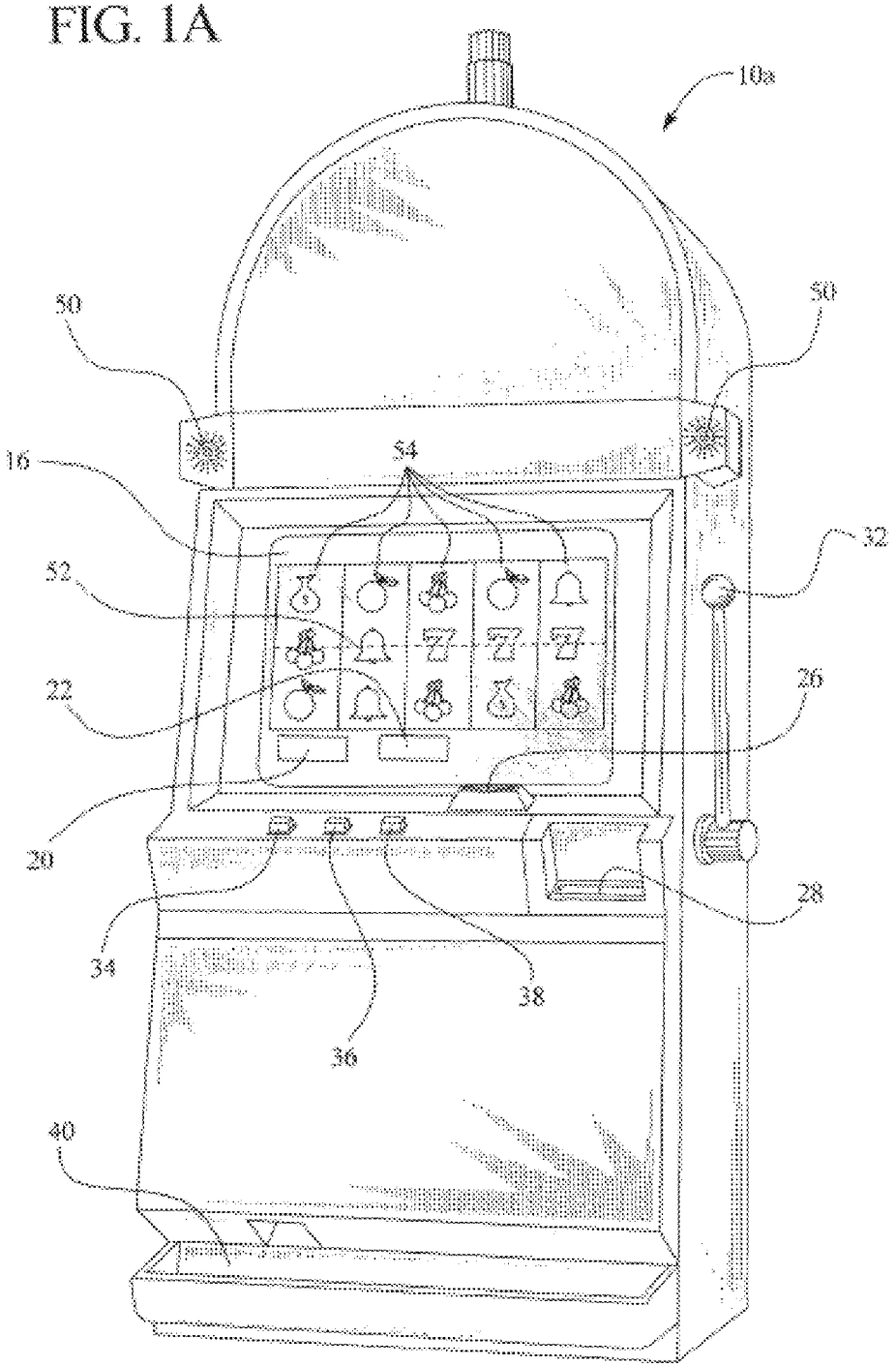
FIG. 1A depicts a front perspective view of a gaming device in the form of a slot machine in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of exemplary embodiments or other examples described herein. However, it will be understood that these examples may be practiced without the specific details. In other instances, well-known methods, procedures, and components have not been described in detail, so as to not obscure the following description. Furthermore, the examples disclosed herein are for exemplary purposes only and other examples may be employed in lieu of, or in combination with, the examples disclosed.

Embodiments of the present invention generally relate to a gaming device having exterior symbols on the outside of a play matrix that may align or coordinate to populate the play matrix, or the like. More specifically, embodiments of the present invention relate to a slot machine game having exterior symbols that appear above and to the left of a play matrix, wherein if an exterior symbol above a first symbol position is the same as an exterior symbol to the left of the first symbol position, the first symbol position is populated with the matching symbol, or the like.

Figure 1B:
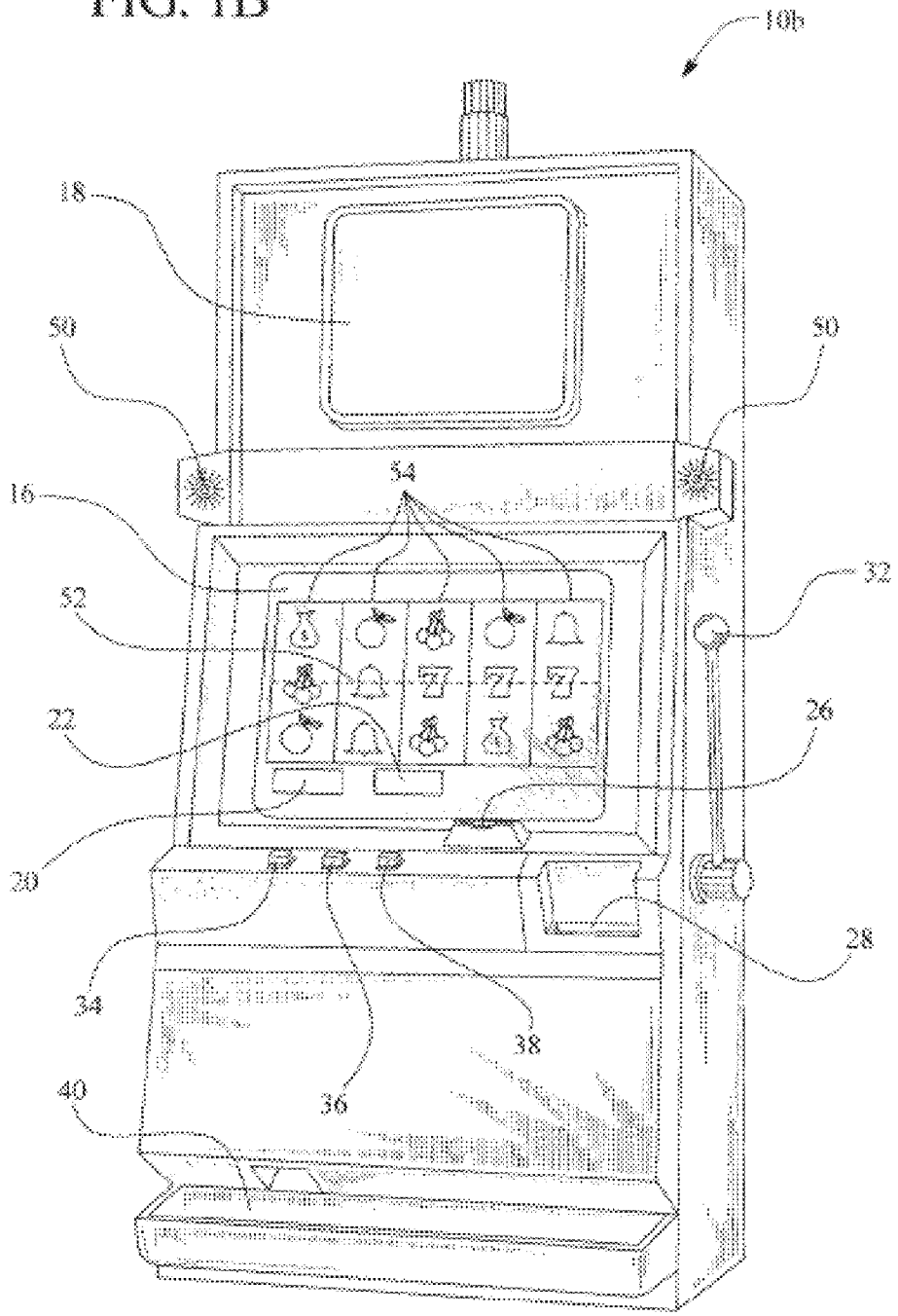
FIG. 1B depicts a front perspective view of a gaming device in the form of a slot machine in accordance with another embodiment of the present invention.

Two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 1C:
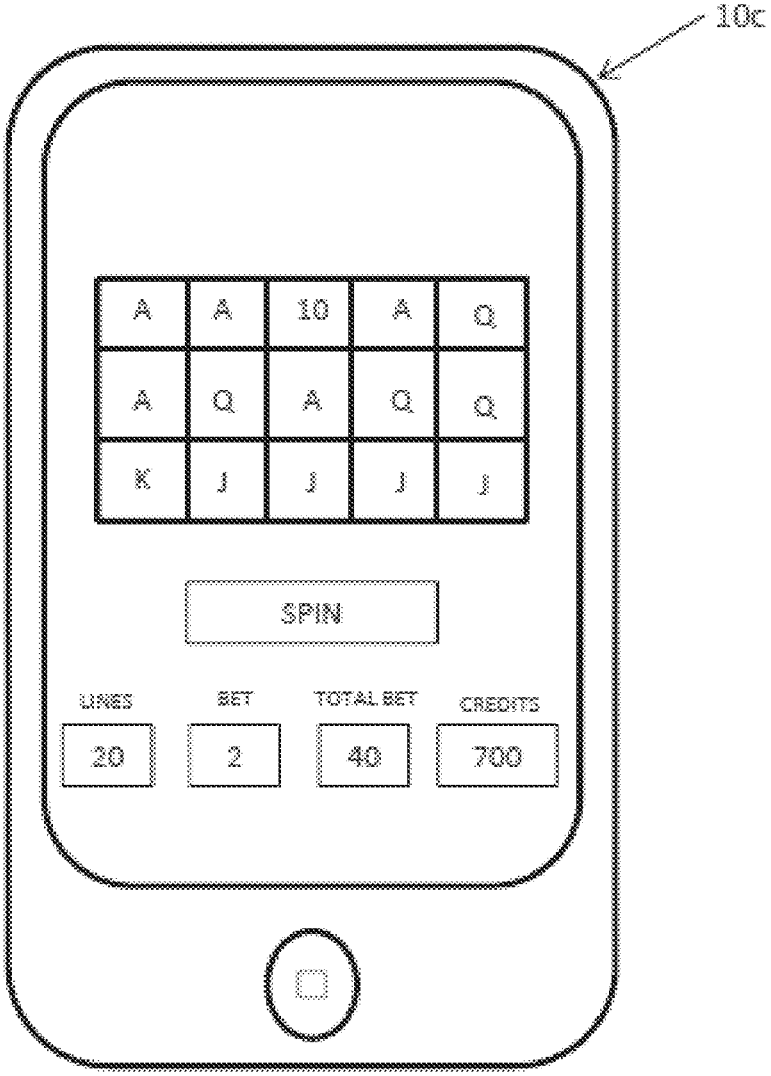
FIG. 1C depicts a front perspective view of a gaming device in the form of a mobile device in accordance with one embodiment of the present invention.
Figure 1D:
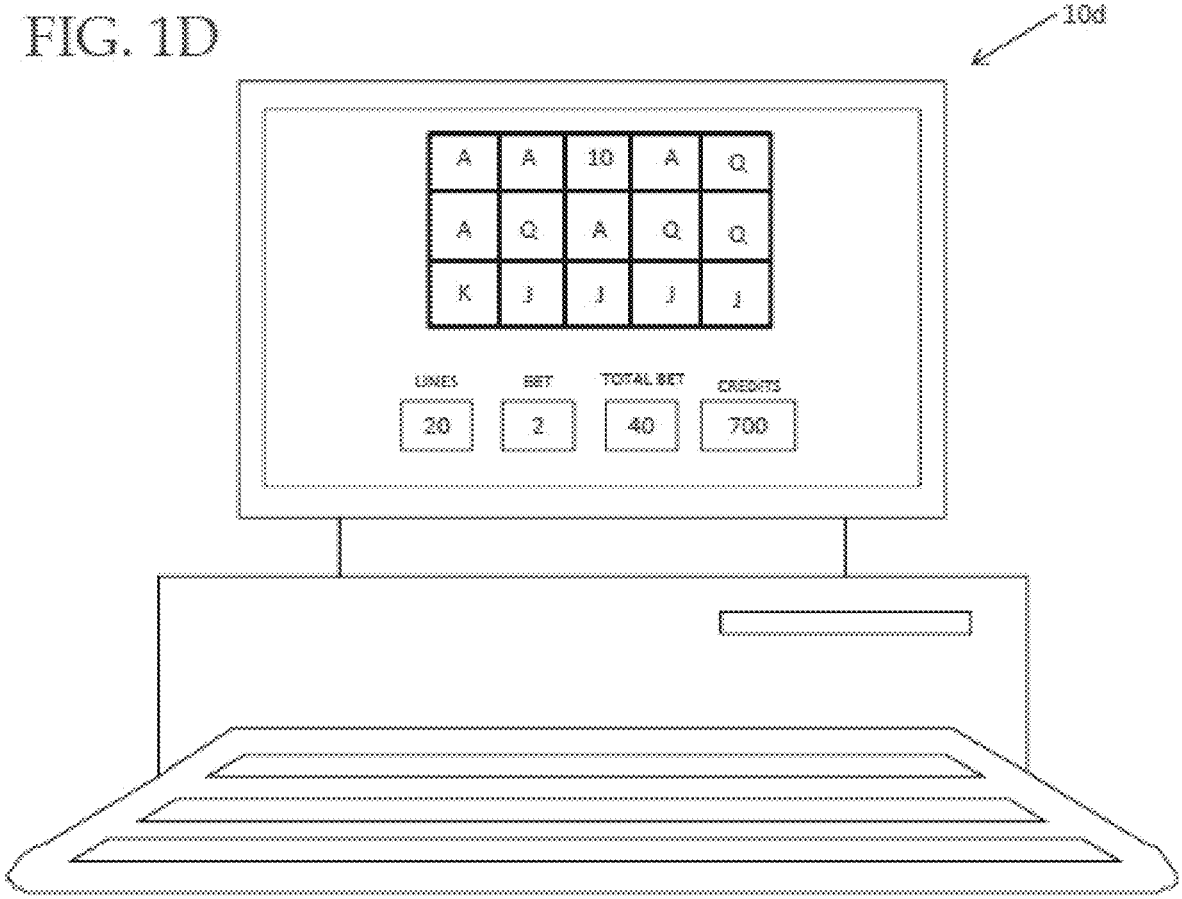
FIG. 1D depicts a front perspective view of a gaming device in the form of a personal computer in accordance with one embodiment of the present invention.
Figure 2A:
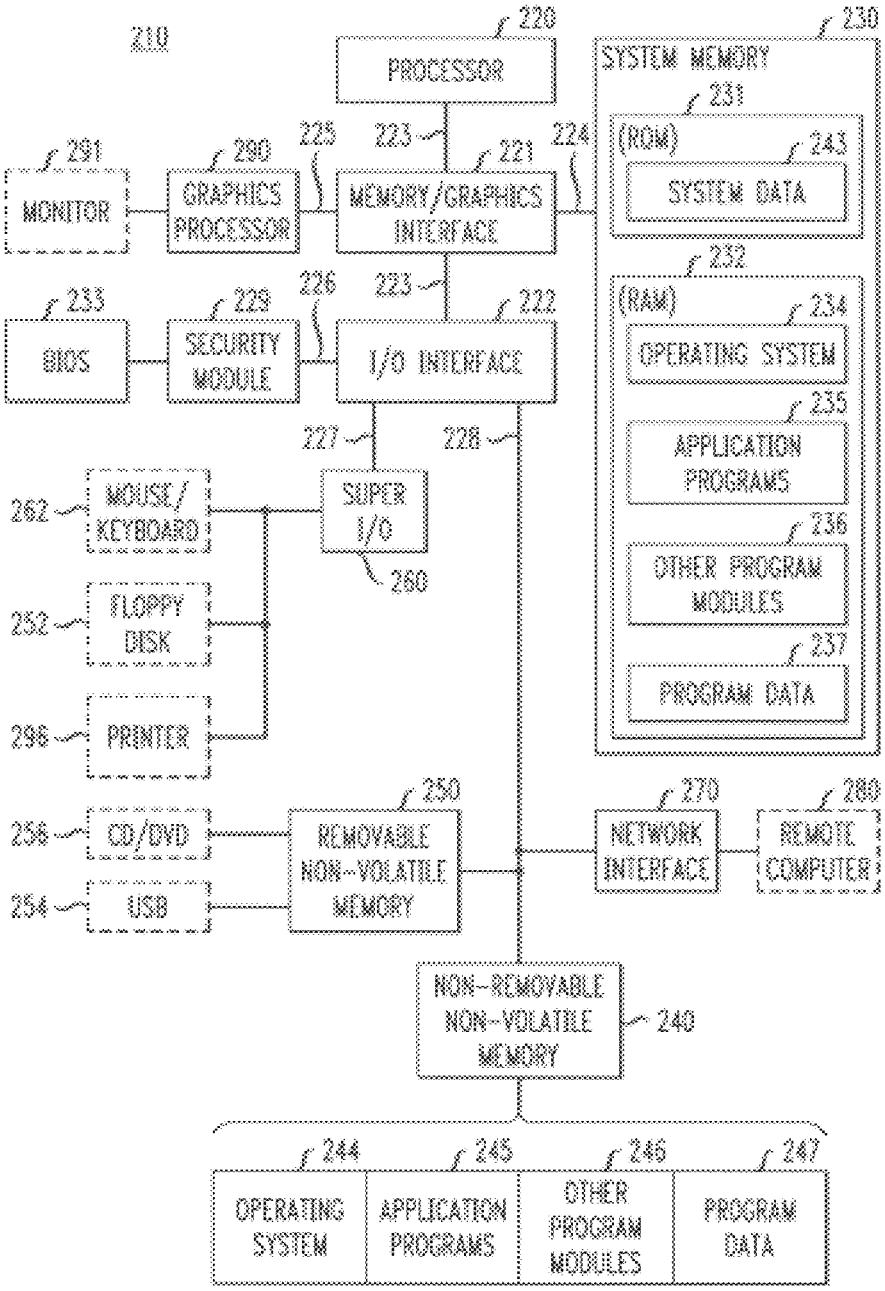
FIG. 2A depicts a schematic block diagram of a general purpose computer system, which may be used with any of the gaming devices of FIGS. 1A-1D, in accordance with embodiments of the present invention.

In several embodiments, the electronic gaming devices, for example, as shown in FIGS. 1A-1D, may comprise all or part of a general purpose computer system, for example, the general purpose computer system of FIG. 2. It should be appreciated, however, the general purpose computing system of FIG. 2 is merely an exemplary embodiment of an electronic device, and actual electronic devices may comprise any one or more components shown in FIG. 2A, suitable for embodiments of the present invention.

With reference to FIG. 2A, a general purpose computer system in the form of a computer 210 is shown. As understood by embodiments of the present invention, components shown in dashed outline are not part of the computer 210, but are used to illustrate the exemplary embodiment of FIG. 2A. Components of computer 210 may include, but are not limited to, a processor 220, a system memory 230, a memory/graphics interface 221, also known as a Northbridge chip, and an I/O interface 222, also known as a Southbridge chip. The system memory 230 and a graphics processor 290 may be coupled to the memory/graphics interface 221. A monitor 291 or other graphic output device may be coupled to the graphics processor 290.

A series of system busses may couple various system components including a high speed system bus 223 between the processor 220, the memory/graphics interface 221 and the I/O interface 222, a front-side bus 224 between the memory/graphics interface 221 and the system memory 230, and an advanced graphics processing (AGP) bus 225 between the memory/graphics interface 221 and the graphics processor 290. The system bus 223 may be any of several types of bus structures including, by way of example, and not limitation, such architectures include Industry Standard Architecture (ISA) bus, Micro Channel Architecture (MCA) bus and Enhanced ISA (EISA) bus. As system architectures evolve, other bus architectures and chip sets may be used but often generally follow this pattern. For example, companies such as Intel and AMD support the Intel Hub Architecture (IHA) and the Hyper transport architecture, respectively.

The computer 210 typically includes a variety of computer readable media. Computer readable media can be any available media that can be accessed by computer 210 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and can accessed by the computer 210.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 230 includes computer storage media in the form of volatile and/or nonvolatile memory such as read only memory (ROM) 231 and random access memory (RAM) 232. The system ROM 231 may contain permanent system data 243, such as identifying and manufacturing information. In some embodiments, a basic input/output system (BIOS) may also be stored in system ROM 231. RAM 232 typically contains data and/or program modules that are immediately accessible to and/or presently being operated on by processor 220. By way of example, and not limitation, FIG. 2 illustrates operating system 234, application programs 235, other program modules 236, and program data 237.

The I/O interface 222 may couple the system bus 223 with a number of other buses 226, 227 and 228 that couple a variety of internal and external devices to the computer 210. A serial peripheral interface (SPI) bus 226 may connect to a BIOS memory 233 containing the basic routines that help to transfer information between elements within computer 210, such as during start-up.

In some embodiments, a security module 229 may be incorporated to manage receipt of money/credits, issuance of money/credits, and enforcement of policies, as may be required in the gaming industry. In many embodiments, such security module 229 may be coupled with a payment acceptor built into a physical machine. A payment acceptor may include a coin slot and a payment, note or bill acceptor, where the player inserts money, coins or tokens. For example, the player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

A super input/output chip 260 may be used to connect to a number of 'legacy' peripherals, such as floppy disk 252, keyboard/mouse/buttons 262, and printer 296, as examples. The super I/O chip 260 may be connected to the I/O interface 222 with a low pin count (LPC) bus, in some embodiments. The super I/O chip 260 is widely available in the commercial marketplace.

In one embodiment, bus 228 may be a Peripheral Component Interconnect (PCI) bus, or a variation thereof, may be used to connect higher speed peripherals to the I/O interface 222. A PCI bus may also be known as a Mezzanine bus.

Variations of the PCI bus include the Peripheral Component Interconnect-Express (PCI-E) and the Peripheral Component Interconnect-Extended (PCI-X) busses, the former having a serial interface and the latter being a backward compatible parallel interface. In other embodiments, bus 228 may be an advanced technology attachment (ATA) bus, in the form of a serial ATA bus (SATA) or parallel ATA (PATA).

The computer 210 may also include other removable/non-removable, volatile/nonvolatile computer storage media. By way of example only, FIG. 2A illustrates a hard disk drive 240 that reads from or writes to non-removable, nonvolatile magnetic media. Removable media, such as a universal serial bus (USB) memory 252 or CD/DVD drive 256 may be connected to the PCI bus 228 directly or through an interface 250. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like.

The drives and their associated computer storage media, discussed above and illustrated in FIG. 2A, provide storage of computer readable instructions, data structures, program modules and other data for the computer 210. In FIG. 2A, for example, hard disk drive 240 is illustrated as storing operating system 244, application programs 245, other program modules 246, and program data 247. Note that these components can either be the same as or different from operating system 234, application programs 235, other program modules 236, and program data 237. Operating system 244, application programs 245, other program modules 246, and program data 247 are given different numbers here to illustrate that, at a minimum, they are different elements within the computer 210. A user may enter commands and information into the computer 210 through input devices such as a mouse/keyboard 262 or other input device combination. Other input devices (not shown) may include a microphone, joystick, game pad, satellite dish, scanner, or the like. These and other input devices are often connected to the processor 220 through one of the I/O interface busses, such as the SPI 226, the LPC 227, or the PCI 228, but other busses may be used. In some embodiments, other devices may be coupled to parallel ports, infrared interfaces, game ports, and the like (not depicted), via the super I/O chip 260.

The computer 210 may operate in a networked environment using logical connections to one or more remote computers, such as a remote computer 280 via a network interface controller (NIC) 270. The remote computer 280 may be a personal computer, a server, a router, a network PC, a peer device or other common network node, and typically includes many or all of the elements described above relative to the computer 210. The logical connection between the NIC 270 and the remote computer 280 depicted in FIG. 2 may include a local area network (LAN), an Ethernet-based network, a wide area network (WAN), or both, but may also include other networks. Such networking environments are commonplace in offices, enterprise-wide computer networks, intranets, and the Internet.

Returning to FIGS. 1A-1D, in one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

As shown by FIGS. 1A and 1B, and supported by the elements depicted in FIG. 2A, many embodiments of the present invention comprise at least one, and often a plurality, of input devices in communication with the processor. The input devices can include any suitable device which enables the player to produce an input signal which is read by the processor, for instructing the game and/or gaming device to do something. In one embodiment, after appropriate funding of the gaming device, the input device is a game activation device, such as a pull arm 32 or a play button 34 which is used by the player to start any primary game or sequence of events in the gaming device. The play button can be any suitable play matching such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, one input device is a touch-screen coupled with a touch-screen controller, or some other touch-sensitive display overlay to allow for player interaction with the images on the display. The touch-screen and the touch-screen controller are connected to a video controller. A player can make decisions and input signals into the gaming device by touching touch-screen at the appropriate places.

In one embodiment, the gaming device includes a sound generating device controlled by one or more sound cards which function in conjunction with the processor. In one embodiment, the sound generating device includes at least one and preferably a plurality of speakers or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Suitable gaming devices may incorporate any suitable wagering primary or base game. The gaming machine or device of embodiments of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into an embodiment of the present invention.

In one embodiment, a base or primary game may be a slot game with one or more pay lines 52. The pay lines may be horizontal, vertical, circular, diagonal, angled or any combination thereof. In this embodiment, the gaming device displays at least one and preferably a plurality of reels 54, for example, having three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which may generally correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a pay line in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
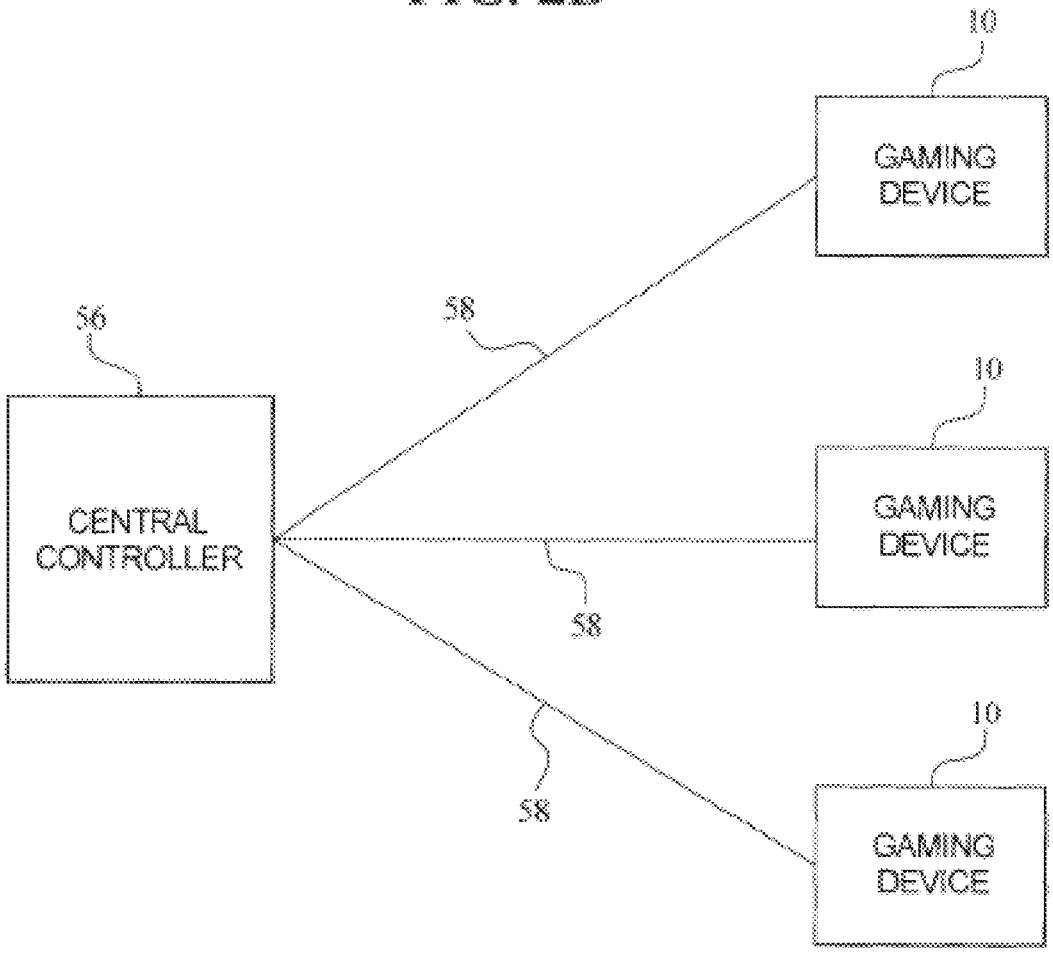
FIG. 2B depicts a schematic block diagram illustrating a plurality of gaming terminals and communication with a central controller in accordance with one embodiment of the present invention.

In one embodiment, as illustrated in FIG. 2B, one or more of the gaming devices 10 of embodiments of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of an embodiment of the present invention. In this embodiment, each of a plurality of such gaming devices is in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is a global computer network, such as the Internet, or an intranet network, and the gaming system may be considered an online system, a mobile system, or the like. In this embodiment, the operation of the gaming device can be viewed at the gaming device with at least one web browser, or application, such that access to the data network is feasible. In this embodiment, operation of the gaming device and accumulation of credits may be accomplished with a connection to the central server or controller through a conventional phone or other data transmission line, digital signal line (DSL), T-1 line, coaxial cable, fiber optic cable, or other suitable connection. In this embodiment, players may access a game page from any location where a network connection and computer, or other gaming device 10, are available. For example, either of the gaming devices of FIGS. 1C and 1D is suitable for accessing such a data network.

The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to some embodiments of the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In some embodiments, the data network may be integrated into an existing network platform, for example, a social networking site. For example, in one embodiment, the data network may comprise an application within a social networking site, e.g., Facebook, whereby players may access the data network via a connection to the social networking site. Such an integrated arrangement may be advantageous for applications of embodiments of the present invention that seek to have near immediate access to a significant potential customer base.

In further embodiments, the data network may be accessed via a downloadable application to a mobile device, such as a smartphone, a tablet, a mobile computer, or the like. As in known in the mobile device industry, such a downloadable application may be stored at a remote server, and upon request, a player may utilize a mobile device to download such downloadable application to be stored locally on the mobile device. Such downloadable application may access the data network through the mobile device's network connection, and provide the player a convenient means through which to access the data network. In alternative embodiments, the downloadable application may not require a network connection on a regular basis, and a game may be accessible locally on the mobile device. However, in such embodiments, some of the benefits of networked game play, such as competitions, updates, etc., may not be available until the mobile device reconnects to the data network.

Figure 3A:
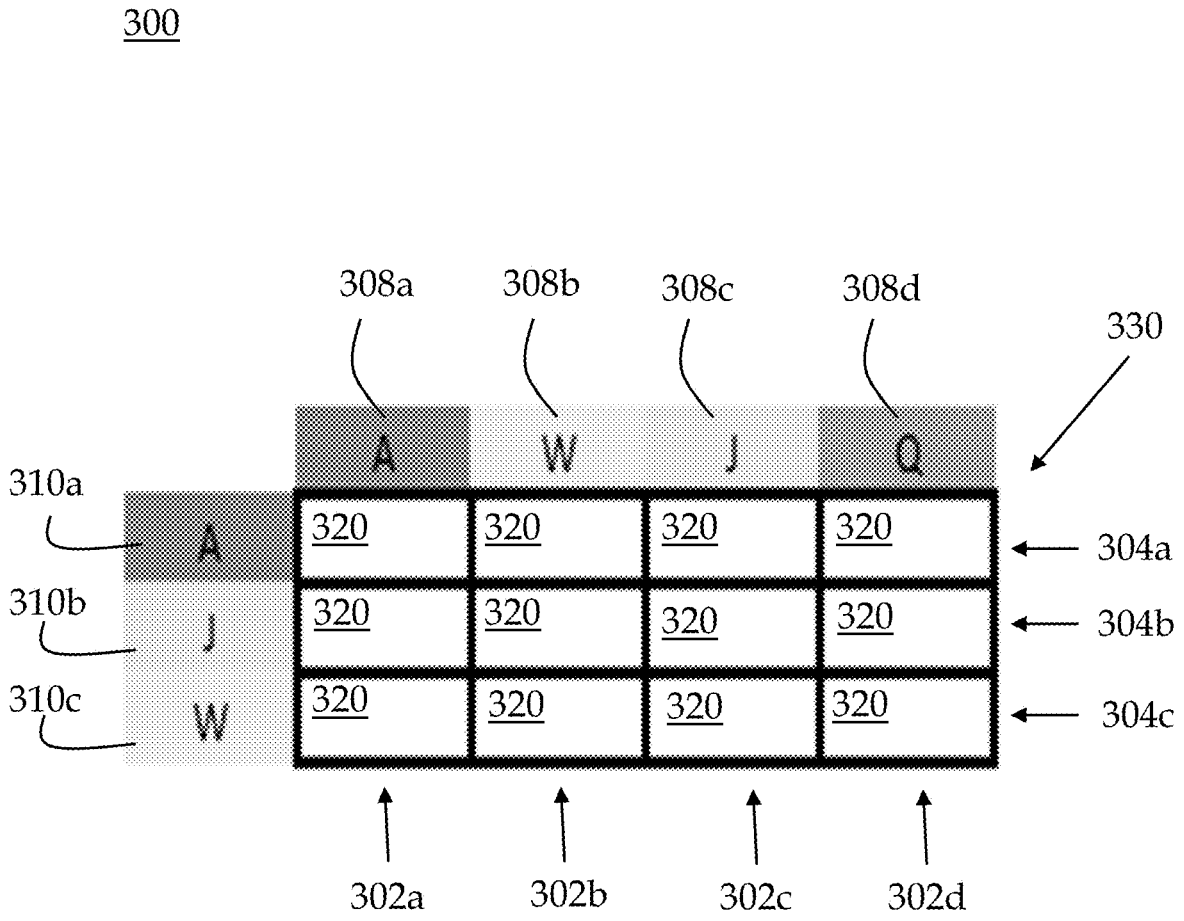
FIG. 3A and FIG. 3B depict representative displays that may be encountered during a typical game in accordance with embodiments of the present disclosure.
Figure 3B:
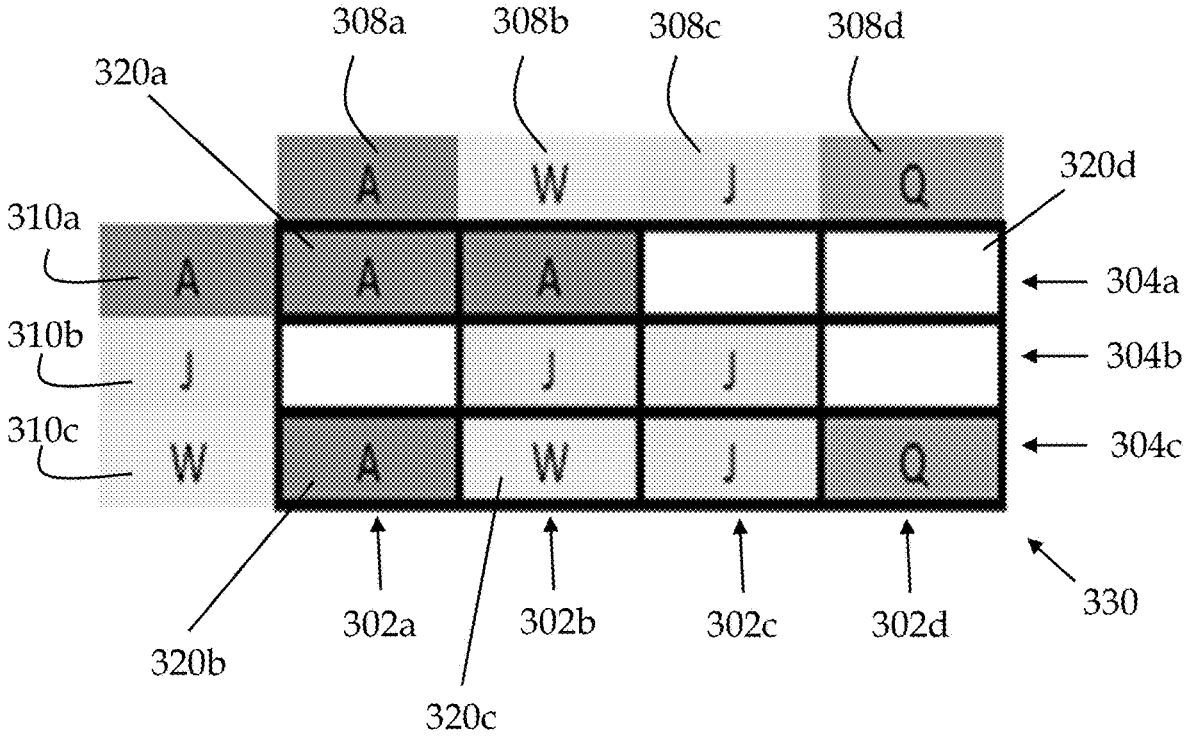

Referring now to FIGS. 3A and 3B an exemplary display 300 showing a play matrix 330 is shown in accordance with embodiments of the present disclosure. In exemplary embodiments, a play matrix 330 may comprise a number of columns 302 and rows 304 intersecting to form interior symbol matrix positions 320. In exemplary embodiments, symbols may appear on top and to the left of a blank matrix (e.g., 1 above each column and 1 to the left of each row).

Symbols in the exterior positions are generally determined by the processor at random. In exemplary embodiments, the exterior positions may each be a single visible position of a reel. In this embodiment, the processor would determine stop positions for the external position reels in order to determine what symbol position and what corresponding symbol to display. It should be appreciated that the processor can determine the external symbols in any symbol selection method known in the art.

If the symbol above a matrix interior symbol position 320 is the same as the symbol to the left of the position 320, or the like, the position 320 is populated with that symbol. If a position 320 has one wild above it and a different symbol on the left (or vice versa), the game may populate the position 320 with the symbol that is not a wild. If the blank interior position 320 has a wild above it and to the left, or the like, the game may populate the position 320 with a wild. If the two symbols do not match and neither is a wild, the game may leave the position 320 blank.

Generally, embodiments of the present invention generate the symbols in the symbol matrix based on symbols outside of the play matrix. In exemplary embodiments, an external a row and a column outside the play matrix dictates the symbols in the active matrix 330 based on whether the corresponding column/row matches or not, or the like. The matrix filling in algorithm may be as set forth above or may be based on any other matching system or the like including based on color of external symbols, arithmetic on external number symbols, or the like.

In alternative embodiments, the symbols in the symbol matrix are based on hidden reels and the external symbols determine whether to display the hidden symbols. That is, a stop position will be selected for each of the hidden reels and the game will determine what symbol should be displayed in each of the symbol matrix positions. Before displaying the symbols, however, the processor will first determine whether the external symbols indicate to display the internal matrix position symbol. In these embodiments, the external symbols may be on/off symbols and the corresponding internal matrix symbol position will only be shown if the symbol in the external symbol position shows an on symbol or illustrates that the symbol should be shown. It should be appreciated that the external symbols can indicate to display the internal symbols in any manner be it matching a cross-sectioned external symbol (by symbol type, color, numerical facevalue, or the like), or any other means to indicate that the internal symbol should be displayed.

In the example depicted in FIGS. 3A and 3B, the matrix 330 may comprise four columns 302*a*, 302*b*, 302*c*, 302*d*, by three rows 304*a*, 304*b*, 304*c*. Any matrix 300 of any size or shape suitable to be displayed by a gaming device, or the like, is contemplated by and within embodiments of the present disclosure. In accordance with exemplary embodiments, exterior symbols 308, 310 may appear above and/or near a side of the matrix. The example displayed depicts four vertical exterior symbol positions 308*a*, 308*b*, 308*c*, and 308*d* displayed above each of the four columns 302*a*, 302*b*, 302*c*, 302*d*, respectively. The example displayed also depicts three lateral exterior symbol positions 310*a*, 310*b*, 310*c* displayed to the left of each of the three rows 304*a*, 304*b*, 304*c* in the matrix 300, respectively. The number and positioning of each row, column, symbol position, or the like depicted in the Figures is for illustrative purposes only and is meant to be an example and not limiting. Any number, size, shape, and/or the like of the rows, columns, symbol positions, and/or the like that are suitable to be displayed by a gaming device, or the like, are contemplated by and within embodiments of the present disclosure.

In exemplary embodiments, a selected symbol may be selected and/or generated for each vertical exterior symbol position 308 and each lateral exterior symbol position 310. The interior symbol positions 320 of the matrix 330 are then populated with a selected symbol when a vertical symbol position 308 and an intersecting lateral symbol position 310*a* display the same selected symbol. After the matrix 330 is populated, to determine if a win is achieved, the symbols may be evaluated as if in a standard slot game, or the like. As such, the standard pay lines, or the like, and methods of winning the game are implemented and the winnings and/or bonus are calculated. The terms user and player are generally used interchangeably herein and may refer to the individual or device playing the game.

In operation, a player may start or activate a game by pressing a button, pulling a lever, or using another activation method consistent with the present disclosure via an input device. Symbols may then be selected and/or generated to be displayed in each of the he vertical exterior positions 308 and the lateral exterior positions 310 via a configured probability or random generation. When a symbol for each vertical exterior position 308 and each lateral exterior position 310 is selected, the matrix 330 may be populated.

Referring now to FIG. 3B, the symbol "A" has been generated and/or selected and is disposed in both a first vertical exterior symbol position 308*a* and a first lateral exterior symbol position 310*a*. In this example, the first vertical exterior position 308*a* and the first lateral exterior symbol position 310*a* intersect at a first interior symbol position 320*a*. The intersecting exterior symbol positions 310*a*, 308*a* include matching symbols, and as such the first interior symbol position 320*a* is populated with the symbol "A." The entire matrix 330 may be populated in the same manner and a win or bonus may be determined based on the resulting matrix 330 after it is populated. In some embodiments, a wild symbol may be present. In embodiments where a wild symbol is present, the interior symbol position in a row or column aligned with the wild symbol may be populated with the same symbol that is present in the corresponding row or column. For example, when a wild or "W" symbol is present in a second lateral exterior symbol position 310*c* and an "A" symbol crossing is present in the first vertical exterior symbol position 308*a*, a second intersecting interior position 320*b* is populated with the "A" because it corresponds to a "W" or wild card. In some embodiments when two corresponding wild symbols intersect at a position, the interior position 320*c* may be populated with a wild symbol. In some embodiments, when a match is not made between the vertical and lateral exterior symbol positions, the resulting interior symbol position 320*d* is left blank. When the matrix 330 is populated, a win and/or bonus may be determined.

In exemplary embodiments, each vertical exterior symbol position 308 is disposed on or displayed on top of a column 302 that intersects with at least one row 304 at an interior symbol position 320. In the example depicted symbols "A", "J", "Q", and "W" are depicted, however any suitable symbol consistent with the present disclosure may be used. In some embodiments, some symbols may include bonus characteristics, for example a wild symbol, a split symbol, or the like.

It should be appreciated that the reels may include any suitable symbols, characters or images as desired by the game designer and that wild symbols may match with any symbol, with a subset of symbols, or only with other wild symbols. Each of the exterior symbol positions 308, 310 may include a randomly determined symbol from a plurality of symbols, based on an algorithmic formula and distribution of symbols, or the like. It should be appreciated that any of the symbols may be in any of the exterior symbol positions with any distribution as prescribed by the game mechanics.

In one embodiment a plurality of pay lines are associated with the reels. In one embodiment, the gaming device provides an outcome to the player when a designated combination of symbols such as a winning combination of symbols is indicated in the matrix 330. In another embodiment, the gaming device provides the outcome to the player when the winning symbol combination is indicated in symbol positions on a plurality of the pay lines in the matrix 330. In a further embodiment, the gaming device provides the outcome to the player when a winning symbol combination is indicated in symbol position on any of the pay lines associated with the matrix 330.

In other embodiments, the player is awarded for the number of matches or the number of matches of a particular type. In these embodiments, player is awarded based on the mere occurrence of a symbol either based on the face/displayed numeric value or in conjunction with the paytable. In some embodiments, the occurrence of two matched symbol will pay more than double the occurrence of one matched symbol.

In other embodiments, an award is only issued if there are a combination of displayed symbols in the interior symbol matrix without regard to orientation. For example, the game mechanics could prescribe that an award is given for the presence of any three of the same symbols in the interior symbol matrix. In the example in FIG. 3B, two awards would be given (one for 3 A symbols; one for 3 J symbols).

Alternatively, game mechanics could prescribe an award only if there are a cluster of connected like symbols in the interior symbol matrix. For example, a game could award a win if there are three or more connected symbols. In the example in FIG. 3B, one award would be given for the 4 Js (3 Js and 1 W) that form a square within the interior play matrix.

It should be appreciated that a designated combination of symbols or a winning symbol combination may be a line pay, a line scatter pay, a reel scatter pay or any suitable winning combination of the symbols, or the like. During play of the base game, the player may receive pays for additional features, such as line and reel scatter pays. Scatter pays award the player a predetermined payout for the appearance of line and reel scatter symbols on the slot reels. It should be noted that the matching symbols may act as any or all types of scatter symbols, and optionally simultaneously therewith.

In some embodiments, the game will issue scatter pay awards which issues a specific number of credits. The credits may be issued immediately or after the completion of a bonus feature e.g., animation sequence or animated bonus game). The calculation of the scatter pay award depends on the type of scatter pay: For the line scatter pay, the number of credits wagered on the winning pay line multiplies the number of credits indicated by the pay table. For example, the player wagered three credits each on five pay lines and collected three times the amount indicated on the pay table. For the reel scatter pay, the total number of credits wagered multiplies the number of credits indicated by the pay table. Alternatively, any award schedule may be used to pay for any pre-determined arrangement of scatter symbols-line-scatter or reel-scatter.

Embodiments of the present invention further include a variety of methods of play that can be programmed on an electronic video slot machine to enable wild symbols to be created in the play matrix. In an exemplary method, "Matching Reels" comprises one or more symbols on the reel strip designated to be updated if the pair of corresponding matching symbols, one in the same row, and the other one in the same reel, are identical or contain one wild symbol. The presence of these pairs of matching symbols in the play matrix on a given spin causes symbols matching the corresponding row and reel positions in the symbol matrix to be updated prior to the win evaluation.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. For example, an element disclosed by one embodiment of the present invention may be included in any other disclosed embodiment, where suitable. All such modifications and variations are intended to be included herein within the scope of this disclosure and the present invention.

The invention claimed is:

1. A game machine comprising:

an input device configured to accept and validate an item of associated with a monetary value, the monetary value establishing a credit balance, the credit balance being increaseable and decreasable based on at least wagering activity;

a symbol matrix on a display device wherein the symbol matrix comprising a plurality of interior matrix positions;

a plurality of exterior symbol positions on the display device wherein the exterior symbol positions are external to the symbol matrix;

a set of program instructions stored on a memory device wherein the program instructions are executable to implement:

selecting a plurality of stop positions using a random number generator and displaying a symbol to display in each of the exterior symbol positions based on the stop position;

determining what symbol to display in each interior matrix position based on the symbols displayed in two of the exterior symbol positions that align with the interior matrix position wherein determining what symbol to display in each interior matrix position is based on whether the symbols in the exterior symbol positions horizontally aligned matches the exterior symbol that is vertically aligned with the interior matrix position;

determining whether to issue an award based on the symbols displayed in the interior matrix positions;

issuing the award if the program instructions so designate; and detecting a command from a cashout input to cause the initiation of a payout, via the cashout device.

2. The game machine of claim 1 further comprising a wild symbol wherein the wild symbol can match with any symbol in an exterior symbol position.

3. The game machine of claim 1 further comprising a plurality of hidden reels.

4. A game machine comprising:

an input device configured to accept and validate an item associated with a monetary value, the monetary value establishing a credit balance, the credit balance being increaseable and decreaseable based on at least wagering activity;

a symbol matrix comprising a plurality of interior matrix positions on a display device;

a plurality of vertical exterior symbol positions on the display device wherein the vertical exterior symbol positions are external to the symbol matrix and aligned vertically with the internal matrix positions;

a plurality of horizontal exterior symbol positions wherein the horizontal exterior symbol positions are external to the symbol matrix and aligned horizontally with the interior matrix positions;

a set of program instructions stored on a memory executable to cause a processor to implement:

selecting a plurality of stop positions using a random number generator and displaying a symbol from the memory to display in each of the exterior symbol positions based on the stop positions;

determining what symbol to display in each interior matrix position based on the symbols displayed in the aligned horizontal and vertical exterior symbol positions;

determining whether to issue an award based on the symbols displayed in the interior matrix positions;

issuing the award if the program instructions so designate, the award displayed on the display device; and detecting a command from a cashout input to cause the initiation of a payout, via the cashout device.

5. The machine of claim 4 wherein determining what symbol to display in each interior matrix position is further based on the alignment of the exterior symbol positions.

6. The machine of claim 5 wherein determining what symbol to display in each interior matrix position is based on whether the symbols in the exterior symbol position horizontally aligned matches the exterior symbol position vertically aligned.

7. The machine of claim 5 wherein the symbols include a wild symbol.

8. The machine of claim 7 wherein the wild symbol can match with any symbol in an exterior symbol position.

9. The machine of claim 4 wherein the award is not based on the alignment of the symbols displayed in the interior matrix positions.

10. The machine of claim 4 further comprising a paytable wherein the award is further based on the paytable.

11. A method of operating a gaming machine comprising:

providing a slot machine comprising:

an input device configured to accept and validate an item associated with a monetary value, the monetary value establishing a credit balance, the credit balance being increaseable and decreaseable based on at least wagering activity;

a memory device having computer-executable instructions stored thereon;

a symbol matrix on a display device wherein the symbol matrix comprises a plurality of interior matrix positions;

a plurality of vertical exterior symbol positions wherein the vertical exterior symbol positions are vertically external to the symbol matrix;

a plurality of horizontal external symbol positions wherein the horizontal exterior symbol positions are horizontally external to the symbol matrix;

a set of program instructions stored on a memory executable to implement:

selecting a plurality of stop positions using a random number generator and displaying a symbol to display in each of the exterior symbol positions based on the stop positions wherein the symbols include a blank symbol;

determine what symbol to display in each interior matrix position based on the symbols displayed in the exterior symbol positions;

determining whether to issue an award based on the symbols displayed in the interior matrix positions;

issuing the award if the program instructions so designate; and detecting a command from a cashout input to cause the initiation of a payout, via the cashout device.

12. The method of claim 11 wherein the symbols include a wild symbol and wherein the wild symbol can match with any symbol in an exterior position.

13. The method of claim 11 further comprising a plurality of hidden reels.

* * * * *